US007104307B2

(12) United States Patent
Newcomb et al.

(10) Patent No.: US 7,104,307 B2
(45) Date of Patent: Sep. 12, 2006

(54) CASTING MOLD FOR ENGINE BLOCK

(75) Inventors: Thomas P Newcomb, Defiance, OH (US); Maurice G Meyer, Freeland, MI (US)

(73) Assignee: General Motors Corporation, Detroit, MI (US)

( * ) Notice: Subject to any disclaimer, the term of this patent is extended or adjusted under 35 U.S.C. 154(b) by 181 days.

(21) Appl. No.: 10/783,405

(22) Filed: Feb. 20, 2004

(65) Prior Publication Data

US 2005/0183841 A1 Aug. 25, 2005

(51) Int. Cl.
*B22D 19/00* (2006.01)

(52) U.S. Cl. ..... 164/112; 164/332

(58) Field of Classification Search ..... 164/132, 164/369, 112, 332
See application file for complete search history.

(56) References Cited

U.S. PATENT DOCUMENTS

| | | | | |
|---|---|---|---|---|
| 5,320,158 | A * | 6/1994 | Helgesen | 164/76.1 |
| 5,361,823 | A | 11/1994 | Kuhn et al. | 164/9 |
| 5,365,997 | A | 11/1994 | Helgesen et al. | 164/103 |
| 5,771,955 | A * | 6/1998 | Helgesen et al. | 164/9 |
| 6,363,995 | B1 * | 4/2002 | Baranzke | 164/100 |
| 6,527,040 | B1 * | 3/2003 | Singer et al. | 164/137 |
| 6,533,020 | B1 | 3/2003 | Shade | 164/137 |
| 6,598,655 | B1 | 7/2003 | Newcomb et al. | 164/28 |

* cited by examiner

*Primary Examiner*—Kevin P. Kerns
(74) *Attorney, Agent, or Firm*—Charles H. Ellerbrock

(57) ABSTRACT

A casting mold for an engine block and method for manufacturing the casting mold. In one embodiment, the casting mold includes a mold seat with a double-curved surface, and a cast-in cylinder liner. The cylinder liner has an axis and an end surface. The end surface is in tangential contact with the double-curved surface in a seated position prior to any thermal expansion of the cylinder liner. In various embodiments, the cylinder liner becomes slightly unseated upon thermal expansion.

21 Claims, 7 Drawing Sheets

CASTING MOLD FOR ENGINE BLOCK

FIELD OF THE INVENTION

The present invention relates to molds used to produce castings that require cylindrical objects to be embedded in the casting, and in particular to casting molds for engine blocks with cast-in cylinder liners.

BACKGROUND OF THE INVENTION

The inner walls of the cylinder bores of internal combustion engines are required to withstand the abrasive action of the piston and its seal rings. In models with cast iron engine blocks, the cast iron provides the required resistance. In other models, including some V-engine blocks in which aluminum or other lightweight material is used, cylinder liners are inserted in the bores to provide adequate wear resistance.

In many engine block casting processes, cylinder liners are an integral part of the casting process and are assembled into the mold before molten metal is introduced into the mold cavity to form the engine block. After casting, when the mold is removed, these cast-in liners are permanently embedded within the cast metal walls of the cylinder bores. To improve the mechanical contact between the cylinder liners and the walls of the cylinder bores and avoid imperfections that are caused by thermal variations between the cylinder liners and the molten metal, the cylinder liners are sometimes pre-heated using, for example, induction heaters.

In a sand casting process, often referred to as the Precision Sand Process, an expendable mold package or package subassembly 40, shown in FIG. 1, is assembled from various mold segments and mold cores 44 that are combined to define, together with the cast-in cylinder liners 46, the internal and external surfaces of the engine block. The mold segments and mold cores are made of resin-bonded sand. Proper positioning of the liners in the mold and prevention of migration of the liners during pre-heating and casting presents an ongoing challenge.

Some attempts to address this problem provide that chamfered cylinder liners remain seated on corresponding chamfered seat surfaces of the mold cores during thermal expansion. The prior art provides for chamfered surfaces that are inclined with respect to a plane perpendicular to the bore axis at specific angles that are calculated to ensure that the liners remain seated and in contact with seat surfaces during pre-heating and casting. These angles are calculated using nominal (theoretical) dimensions for the length and radius of the cylinder liners and assume uniform in-situ thermal expansion of the liners. In practice, these ideal conditions are not met and the variation can cause the cylinder liners to exert force against the constraining mold seats. As a result, the mold seats will move relative to one another and/or the resin-bonded sand will fracture or crush, contaminating the mold. Either of these unintended consequences is undesirable and potentially more catastrophic than a small amount of cylinder liner migration.

Therefore, improved casting molds with cast-in cylinder liners are still needed.

SUMMARY OF THE INVENTION

One embodiment of the invention provides a casting mold for an engine block. The casting mold includes a first mold seat with a double-curved surface, and a cast-in cylinder liner. The cylinder liner has an axis and a conical chamfer.

The conical chamfer is in tangential contact with the double-curved surface in a seated position prior to any thermal expansion of the cylinder liner. In one related embodiment, the cylinder liner becomes slightly unseated from the seated position upon thermal expansion.

In another embodiment of the invention, the casting mold includes a second mold seat that has a double-curved surface in contact with the cylinder liner prior to any thermal expansion.

In yet another embodiment, the first and second mold seats have conical surfaces in contact with corresponding end surfaces of the cylinder liner, such that upon thermal expansion, the cylinder liner becomes slightly unseated from the seated position. The end surfaces of the cylinder liner may be conical or double-curved surfaces.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The present invention will become more fully understood from the detailed description and the accompanying drawings. The components in the figures are not necessarily to scale, emphasis instead being placed upon illustrating the principles of the invention. Moreover, in the figures, like reference numerals designate corresponding parts throughout the different views.

DETAILED DESCRIPTION OF VARIOUS EMBODIMENTS OF THE INVENTION

Figure 1:
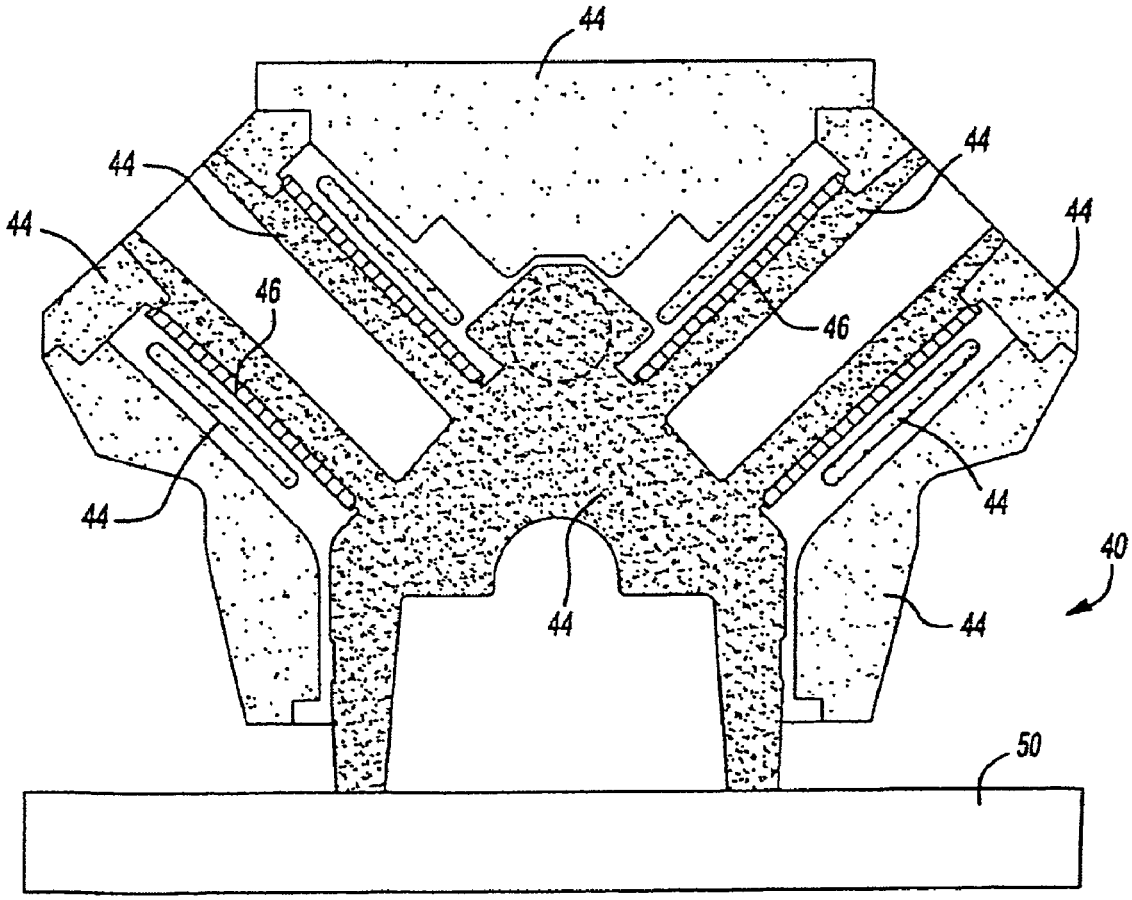
Fig-1 Prior Art
FIG. 1 is a sectional view of a partial mold package shown assembled on a temporary base.

The following description of the preferred embodiments is merely exemplary in nature and is in no way intended to limit the invention, its application, or uses. Referring to the drawings, it is to be understood that standard components or features that are within the purview of an artisan of ordinary skill and do not contribute to the understanding of the various embodiments of the invention are omitted from the drawings to enhance clarity. In addition, it will be appreciated that the characterizations of various components and orientations described herein as being "vertical" or "horizontal" are relative characterizations only based upon the particular position or orientation of a given component for a particular application.

Figure 2A:
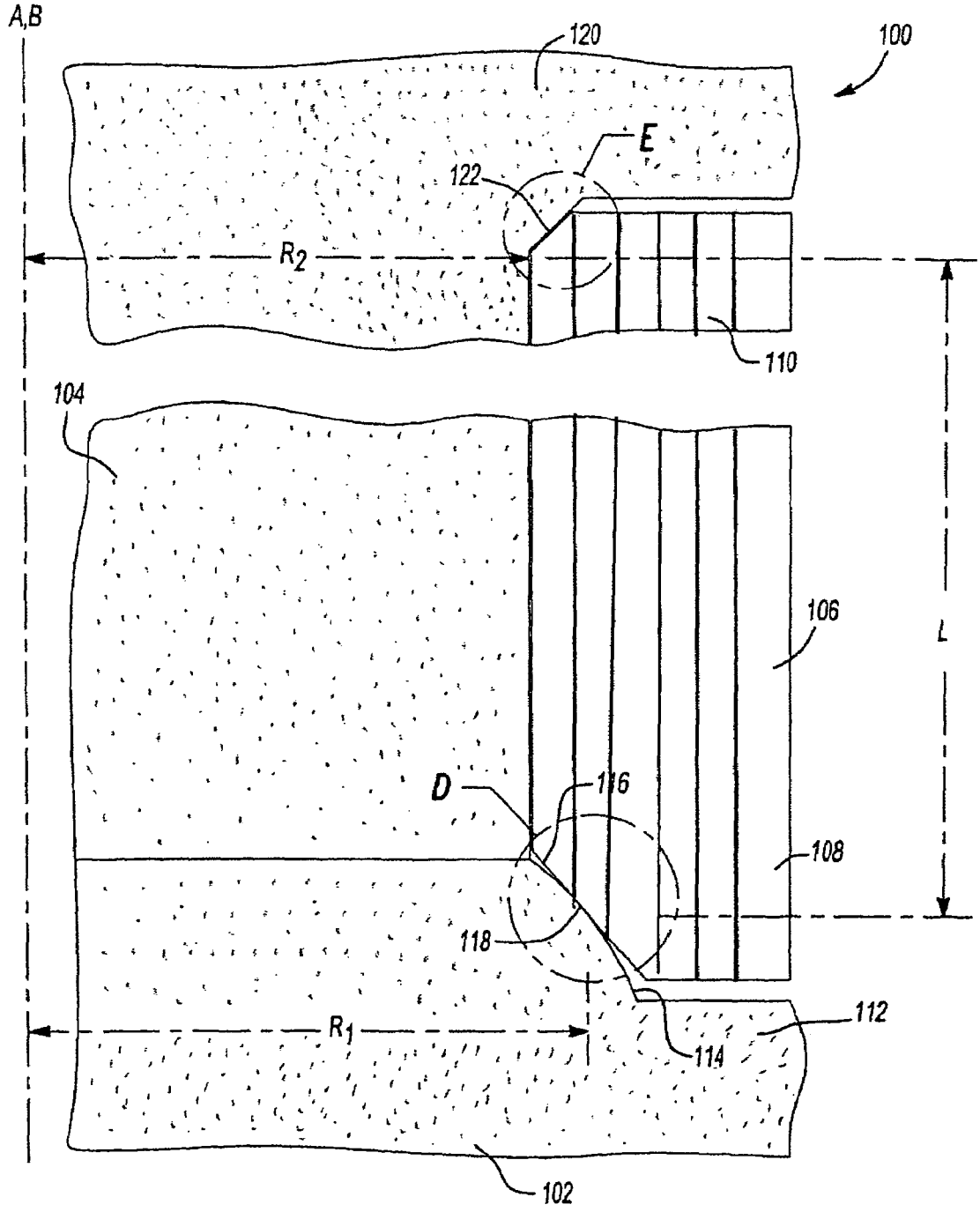
FIG. 2*a* is a partial sectional view of an embodiment of a casting mold according to the present invention.

Referring to FIG. 2*a*, an embodiment of a casting mold 100 for an engine block is shown in partial section about an axis of symmetry denoted by "A", which coincides with the longitudinal axis of one of the cylinder bores of the engine block. It will be understood that the engine block includes one or many cylinder bores, for example eight bores for a V-8 engine, although for simplicity, the various embodiments of the invention are described in connection with a single cylinder bore, without so limiting the invention. The casting mold 100 includes several mold parts, such as a slab core 102 and a barrel core 104. The mold parts are resin-bonded sand cores and can be made using conventional processes, such as a furan hot box or a phenolic urethane cold box core making process. Cores can be made using a variety of sands, such as silica, zircon, fused silica, etc. It will also be appreciated that the slab core 102 and the barrel core 104 may be each made as one integral piece or alternatively as a combination of smaller interconnected mold parts. A cast-in cylinder liner 106 is tightly confined between the slab core 102 and the barrel core 104. The cylinder liner 106 has a longitudinal axis "B" which coincides with the axis A when the cylinder liner 106 is aligned in the casting mold and there is no radial or axial displacement or tilting of axis B with respect to axis A, as shown in FIG. 2*a*. This position of the cylinder liner 106 is defined herein as the "seated position".

The cylinder liner 106 has a first end 108 adjacent to the slab core 102 and a second end 110 adjacent to the barrel core 104. In the embodiment shown in FIG. 2*a*, the first end 108 of the cylinder liner 106 is in contact with a first mold seat 112, which may be defined by a portion of the slab core 102. The first mold seat 112 has a convex double-curved surface 114, which is symmetric about the axis A and has two radii of curvature at each point. Such a surface is generated by revolving a curved line about the axis A, which is the axis of revolution or symmetry. Conical or cylindrical surfaces, which may be obtained when one radius goes to infinity, are single-curved surfaces. The double-curved surface 114 of the first mold seat may be, for example, a portion of a sphere or torus.

Figure 4:
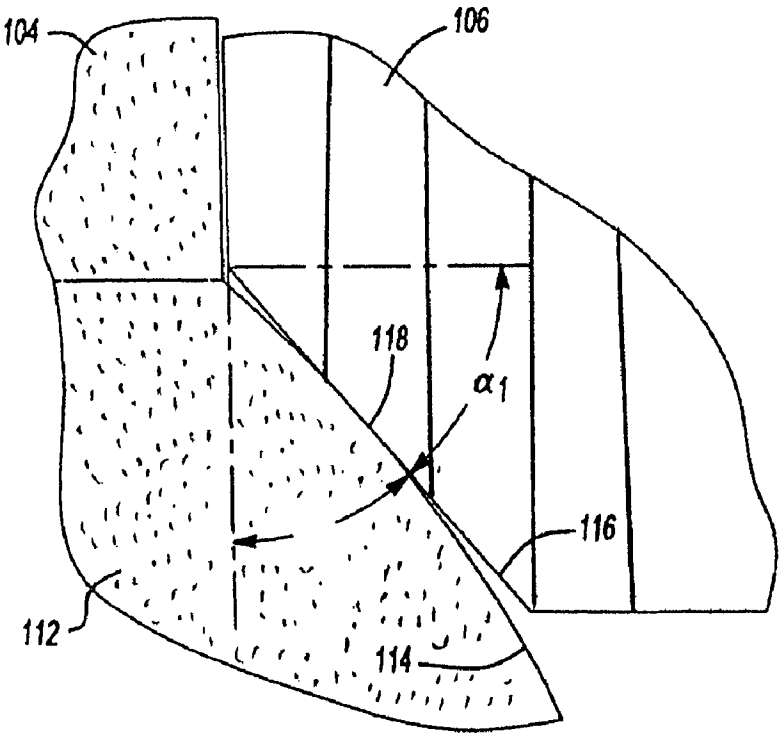
FIG. 4 is an enlarged view of Detail D of FIG. 2*a;*

The cylinder liner 106 contacts the surface 114 of first mold seat 112 along a contact circle 118. The contact circle 118 lies on a plane perpendicular to the axis A and has radius $R_1$. In one embodiment, the first end 108 of the cylinder liner includes a first end surface 116, which, in this embodiment, is a conical chamfer, as best seen in Detail D, FIG. 4. The chamfer 116 is tangent to the first mold seat surface 114 along the contact circle 118 and defines an angle $\alpha_1$ with the plane of the contact circle 118, which is perpendicular to the axis A.

Figure 3:
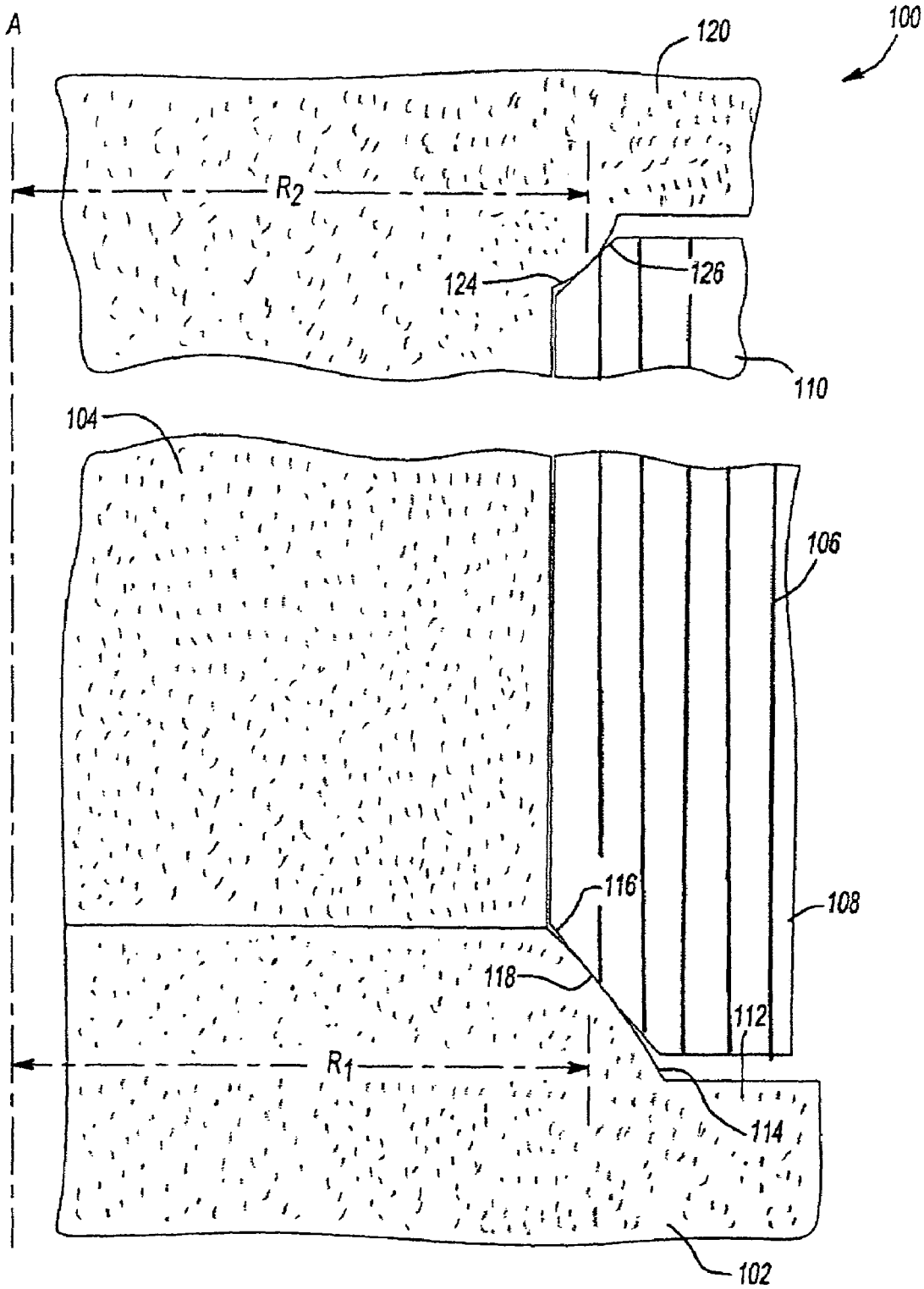
FIG. 3 is a partial sectional view of another embodiment of a casting mold according to the present invention.
Figure 5:
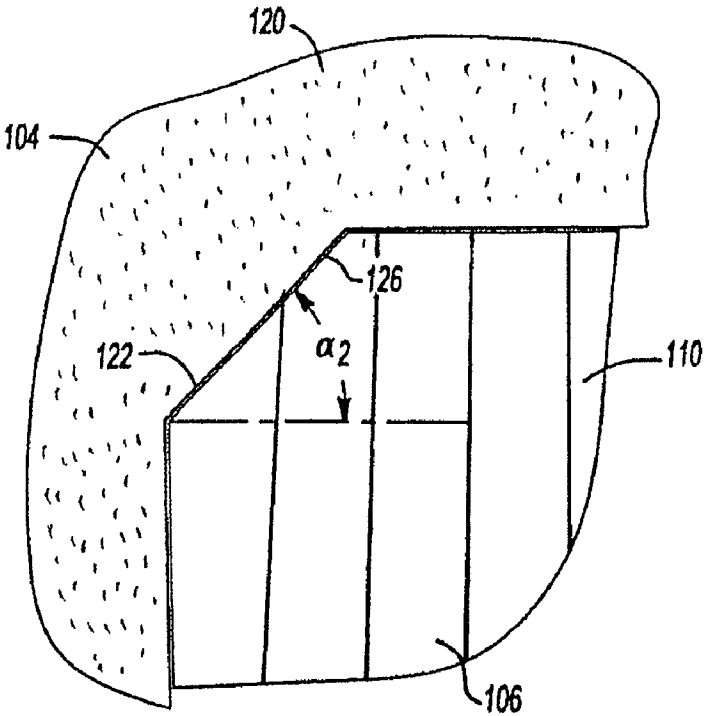
FIG. 5 is an enlarged view of Detail E of FIG. 2*a;*

The second end 110 of the cylinder liner 106 is in contact with a second mold seat 120. The second mold seat 120 may contact the second end 110 at a conical surface 122, as shown in FIG. 2*a*, or at a double-curved surface 124, which is similar to the double-curved surface 114 of the first mold seat 112, as shown in FIG. 3. In the embodiment of FIG. 2*a*, the conical surface 122 is inclined at an angle $\alpha_2$ with a plane perpendicular to the axis A, as best illustrated in Detail E, FIG. 5. The cylinder liner 106 may also include a second end surface 126, which, in this embodiment, is a conical chamfer having the same inclination $\alpha_2$. In the embodiment of FIG. 3, the second chamfer 126 contacts the double-curved surface 124 of the second mold seat 120 tangentially at an angle $\alpha_2$, which is defined by the second chamfer 126 and a plane perpendicular to the axis A. When the double-curved surfaces 114 and 124 of the first and second mold seats 112 and 120 are mirror images of each other, $\alpha_2=\alpha_1=\alpha$.

Figure 7:
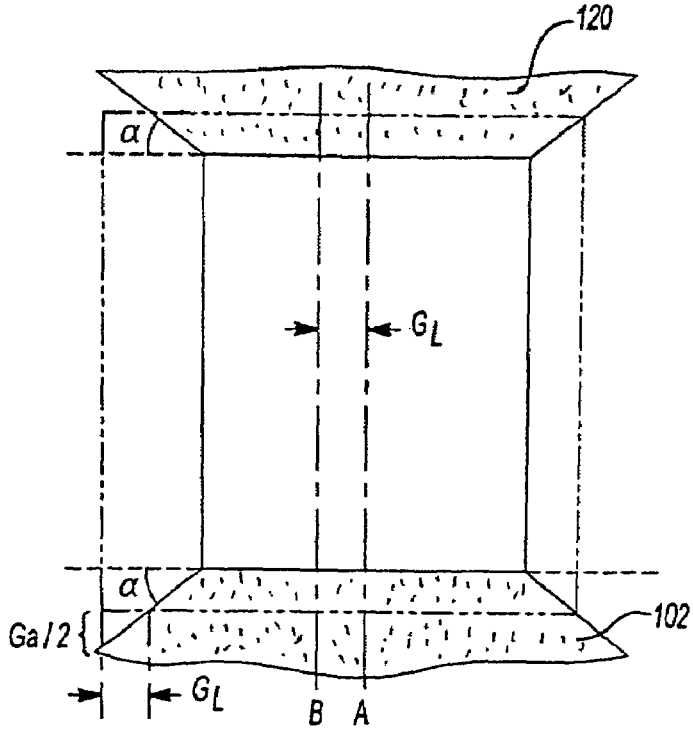
FIG. 7 is cross-sectional views of the casting mold of the invention showing an amount of lateral unseating.

If all mold components are properly formed and assembled, in its initial state, before any heating resulting from the preheating process (if employed) or from the casting process, the cylinder liner 106 is seated on the first and second mold seats 112 and 120; that is the axis A of the bore coincides with the axis B of the cylinder liner 106, such that the cylinder liner 106 is not laterally displaced with respect to the axis of the bore A. The cylinder liner 106 is constrained by the first and second mold seats 112, 120. The angles $\alpha_1$ and $\alpha_2$ are selected such that the cylinder liner 106 will become "unseated", or no longer tightly confined by the first and second mold seats 112, 120, upon heating. Thus, the axis B of the cylinder liner 106 will become laterally displaced relative to the axis A by some amount, as shown in FIG. 7. An unseated cylinder liner 106 will be moved out of position by gravity, local adhesion of the cylinder liner to one or both of the seats 112, 120, or unbalanced metal pressure.

Figure 2B:
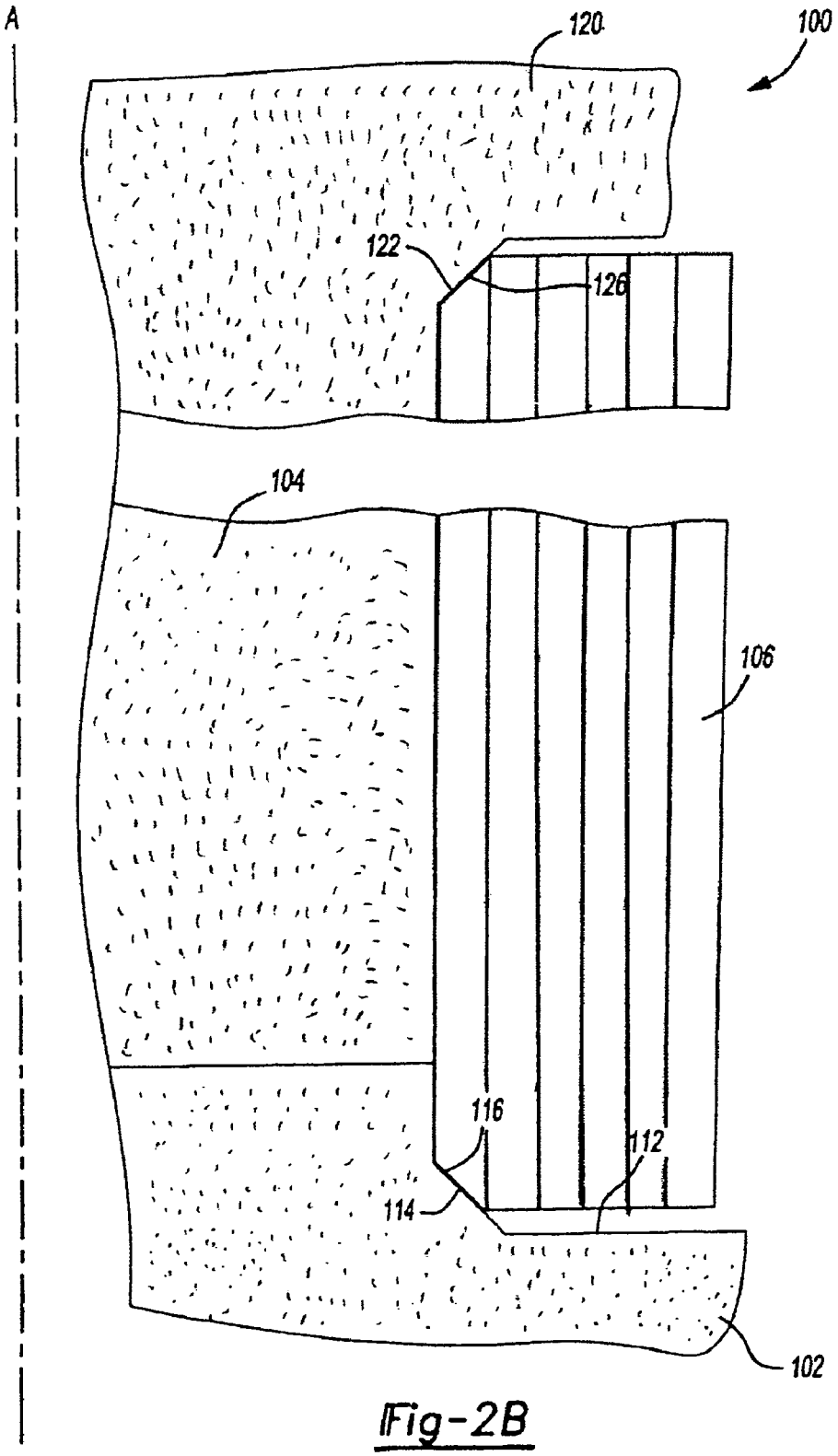
FIG. 2*b* is a partial sectional view of another embodiment of a casting mold according to the present invention.
Figure 2C:
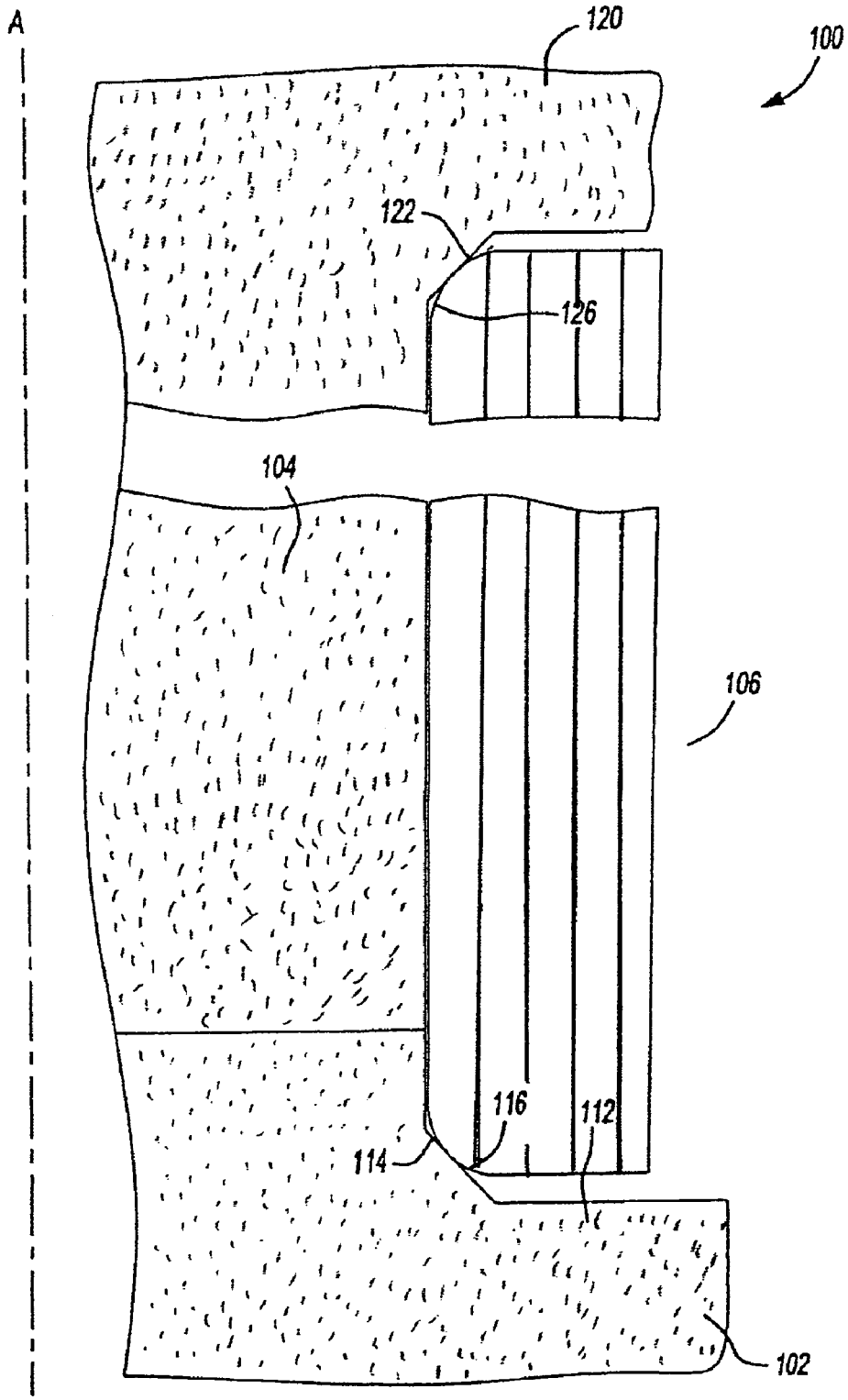
FIG. 2*c* is a partial sectional view of another embodiment of a casting mold according to the present invention.

In other embodiments, shown in FIGS. 2*b* and 2*c*, the first mold seat 112 of FIG. 2*a* may be also configured to have a conical surface which is a mirror image of the conical surface 122 inclined at an angle $\alpha_1=\alpha_2$ with a plane perpendicular to the axis A such that upon thermal expansion the cylinder liner 106 becomes unseated from the seated position on the first and second mold seats 112 and 120. The cylinder liner 106 has first and second end surfaces 116, 126 mating with the conical surfaces 114, 122 of the mold seats 112, 120. In the embodiment of FIG. 2*b*, the end surfaces 116, 126 are conical chamfers. In the embodiment of FIG. 2*c*, the end surfaces 116, 126 of the cylinder liner 106 are double-curved surfaces.

A small migration or misalignment of the axis B relative to the axis A during the preheating and/or casting processes is insignificant compared to the damage that may be caused if the cylinder liner 106 is constrained to be seated during these processes on the first and second mold seats 112, 120. According to the present teachings, unanticipated and/or unaccounted for thermal expansion of the cylinder liner 106 that differs from theory will be accommodated without pushing apart the seats and/or crushing or fracturing the seat material and contaminating the mold. Unanticipated and or unaccounted thermal expansion generally results from normal process variations in the actual dimensions and angles of the mold seats 112, 120 and the cylinder liner 106, as well as non-uniform thermal expansions during preheating and/or mold filling.

The undesirable consequences of unpredictable thermal expansion of the cylinder liner 106 are avoided in the present invention by designing the mold seats 112, 120 and the cylinder liner such that the cylinder liner becomes slightly unseated during thermal expansion. This is accomplished by allowing an amount of unconstrained expansion at one or both ends 108, 110 of the cylinder liner 106. In this regard, the chamfer angles $\alpha_1$ and $\alpha_2$ are selected to exceed the nominal values that are theoretically required for constrained seating by an amount that will not cause excessive unseating or misalignment of the cylinder liner 106. The nominal angles required for constant seating for the embodiments of FIGS. 2*a*, 2*b* and 3 are determined by the following equation:

$$R_1 \times \tan \alpha_1 + R_2 \times \tan \alpha_2 = L,$$

Where L is the length of the cylinder liner 106 determined at its contact with the mold seats 112, 120, and $R_1$ and $R_2$ are the corresponding radii at the contact with the mold seats. If $R_1=R_2=R$ and $\alpha_1=\alpha_2=\alpha$, then:

$$\tan \alpha = L/2R$$

As an example, consider a cast iron liner with R=47.5 mm and L=140 mm. For this cylinder liner, the nominal angle $\alpha$ for constrained seating is equal to 55.84°, and the coefficient of thermal expansion (k) is equal to $5.9\times10^{-6}$/° F. For a change in temperature of 1000° F., if $\alpha_1$ and $\alpha_2$ are chosen to be 10° higher than the nominal angle value, or 65.84°, the amount of axial unseating $G_a$ may be calculated as follows. The change in length is $\Delta L$:

$$\Delta L=1000\times5.9\times10^{-6}\times140=0.826\text{ mm}$$

The change in radius R is $\Delta R$:

$$\Delta R=1000\times5.9\times10^{-6}\times47.5=0.280\text{ mm}$$

Figure 6:
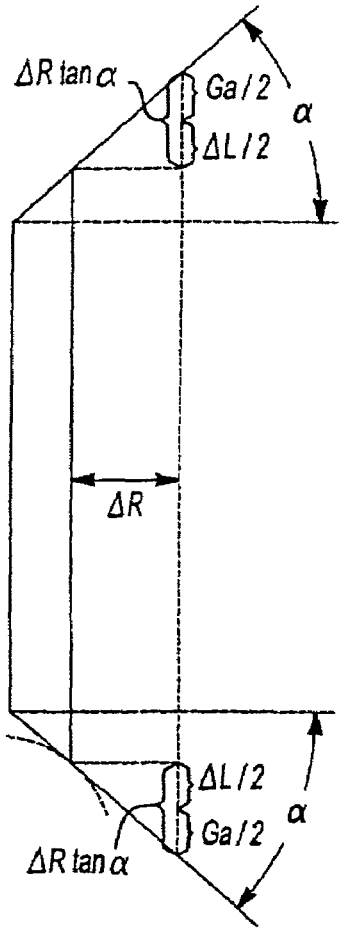
FIG. 6 is a simplified diagram useful for illustrating an amount of axial unseating upon thermal expansion of a cylinder liner according to the present invention.

Referring to FIG. 6, the axial unseating $G_a$ is measured from the tangents to the mold seats at the initial contact points:

$$G_a=2\ \Delta R\ \tan(65.84°)-\Delta L=0.424\text{ mm.}$$

Similarly, if only the first angle $\alpha_1$ is increased by 10° to 65.84°, while the second angle $\alpha_2$ is kept at the nominal value of 55.84°, the axial unseating $G_a$ is:

$$G_a=\Delta R\ \tan(65.84°)+\Delta R\ \tan(55.84°)-\Delta L=0.212\text{ mm.}$$

Therefore, for the cylinder liner of this example an increase of one of the chamfer angles by 10° causes the cylinder liner 106 to become axially unseated only by 0.212 mm. An increase of both chamfer angles $\alpha_1$ and $\alpha_2$ by 10° causes the cylinder liner 106 to become axially unseated only by 0.424 mm.

The cylinder liner 106 is free to migrate laterally to the desired bore centerline as a result of $G_a$. Referring to FIG. 7, it can be shown that the lateral displacement $G_L$ is equal to $(G_a/2)/\tan\alpha$. In the present example, if both angles are increased by 10°, this results in 0.095 mm of lateral migration.

It will be appreciated from these calculations that by increasing one or both chamfer angles $\alpha_1$ and $\alpha_2$ by as much as 10° from the nominal values that keep the cylinder liner 106 seated upon thermal expansion, only small radial or axial unseating of the cylinder liner 106 will occur, while many other advantages are realized in addition to preventing mold seat crushing or fracture. For example, the double-curved surface 114 reduces or eliminates scuffing of the mold seat 112 against the corner of the chamfer 116 of the cylinder liner 106. The increased chamfer angles $\alpha_1$ or $\alpha_2$ facilitate the insertion of mold seat 102 into the cylinder liner 106 during assembly of the mold 100, such that the cylinder liner 106 can be correctly assembled, especially in the case of V-type engines where the cylinder liners 106 are typically not vertical at the time the mold is assembled, as illustrated in FIG. 1, in which the mold package 40 is supported on a temporary base 50.

Greater chamfer angles $\alpha_1$ and $\alpha_2$ result in a smaller amount of lateral displacement $G_L$ for a given amount of axial unseating $G_a$. Smaller lateral displacement $G_L$ helps provide better control of any cylinder liners 106 which are unseated following mold assembly because of dimensional imperfections in the slab core 102, barrel core 104 and cylinder liners 106 when the casting mold 100 is assembled.

While various embodiments of the invention have been described, it will be apparent to those of ordinary skill in the art that other embodiments and implementations are possible that are within the scope of this invention. Accordingly, the invention is not restricted except in light of the attached claims and their equivalents.

What is claimed is:

1. A casting mold for an engine block, the casting mold comprising:

a mold seat comprising a double-curved surface; and a cast-in cylinder liner comprising an axis and a conical chamfer, wherein the conical chamfer is in a tangential contact with the double-curved surface in a seated position absent thermal expansion of the cylinder liner, wherein a first curved region of the double-curved surface is located on a first side of the tangential contact and a second curved region of the double-curved surface is on a second side of the tangential contact, wherein the double-curved surface forms a portion of one of a spherical surface or a toroidal surface about an axis.

2. The casting mold of claim 1, wherein the conical chamfer forms an angle a with a plane perpendicular to the axis, such that the cylinder liner is unseated from the seated position upon thermal expansion.

3. The casting mold of claim 1, wherein the double-curved surface is a spherical segment.

4. The casting mold of claim 1, wherein the double-curved surface is a toroidal segment.

5. A casting mold for an engine block, the casting mold comprising:

a first mold seat comprising a double-curved first surface;

a second mold seat comprising a conical second surface; and a cast-in cylinder liner comprising an axis and conical first and second chamfers, wherein the first and second chamfers are respectively in contact with the first and second surfaces at first and second contact circles in a seated position, such that upon thermal expansion the cylinder liner becomes unseated from the seated position, wherein a first curved region of the double-curved surface is located on a first side of the tangential contact and a second curved region of the double-curved surface is on a second side of the tangential contact, further wherein the double-curved surface forms a portion of one of a spherical surface or a toroidal surface about an axis of the cast-in cylinder liner.

6. The casting mold of claim 5, wherein the first and second chamfers form angles $\alpha_1$ and $\alpha_2$ respectively relative to a plane perpendicular to the axis, and wherein $\alpha_1$ is greater than the angle defined by $\tan^{-1}(L/2R)$, and $\alpha_2$ is equal to $\tan^{-1}(L/2R)$, wherein L is the length of the cylinder liner between the contact circles and R is the inner radius of the cylinder liner at the contact circles.

7. The casting mold of claim 5, wherein the first and second chamfers form angles $\alpha_1$ and $\alpha_2$ respectively relative to a plane perpendicular to the axis, and wherein $\alpha_1$ is greater than the angle defined by $\tan^{-1}(L/2R)$, and $\alpha_2$ is greater than $\tan^{-1}(L/2R)$, wherein L is the length of the cylinder liner between the contact circles and R is the inner radius of the cylinder liner at the contact circles.

8. A casting mold for an engine block, the casting mold comprising:

a double-curved mold seat comprising a conical surface, wherein said double-curved mold seat forms a portion of one of a spherical surface or a toroidal surface about an axis of a cast-in cylinder liner;

a cast-in cylinder liner comprising an axis and contacting the conical surface in a seated position absent thermal expansion, wherein the conical surface is inclined at an angle a with a plane perpendicular to the axis, such that upon thermal expansion the cylinder liner becomes unseated from the seated position.

9. A casting mold for an engine block, the casting mold comprising:

a first mold seat comprising a double-curved first surface;

a second mold seat comprising a double-curved second surface; and a cast-in cylinder liner comprising an axis and first and second chamfers, wherein the first and second chamfers are respectively in a first and a second tangential contact with the first and second surfaces at first and second contact circles in a seated position, wherein the first tangential contact forms a first region of the double-curved first surface on a first side of the first tangential contact and forms a second region of the double-curved first surface on a second side of the tangential contact, and wherein the second tangential contact forms a first region of the double-curved second surface on a first side of the tangential contact and forms a second region of the double-curved second surface on the second side of the tangential contact, further wherein the double-curved surface of the first mold seat and of the second mold seat form a portion of one of a spherical surface or a toroidal surface about an axis of the cast-in cylinder liner, such that upon thermal expansion the cylinder liner becomes unseated from the seated position.

10. The casting mold of claim 9, wherein the first and second chamfers are inclined at angles $\alpha_1$ and $\alpha_2$ respectively relative to a plane perpendicular to the axis, and wherein $\alpha_1$ is greater than the angle defined by $\tan^{-1}(L/2R)$, and $\alpha_2$ is equal to $\tan^{-1}(L/2R)$, wherein L is the length of the cylinder liner between the contact circles and R is the inner radius of the cylinder liner at the contact circles.

11. The casting mold of claim 9, wherein the first and second chamfers form angles $\alpha_1$ and $\alpha_2$ respectively relative to a plane perpendicular to the axis, and wherein $\alpha_1$ is greater than the angle defined by $\tan^{-1}(L/2R)$, and $\alpha_2$ is greater than $\tan^{-1}(L/2R)$, wherein L is the length of the cylinder liner between the contact circles and R is the inner radius of the cylinder liner at the contact circles.

12. The casting mold of claim 11, wherein $\alpha_1 = \alpha_2$.

13. The casting mold of claim 9, wherein each double-curved surface comprises a spherical portion.

14. The casting mold of claim 9, wherein each double-curved surface comprises a toroidal portion.

15. A casting mold for an engine block, the casting mold comprising:

a first mold seat comprising a first double-curved surface;

a second mold seat comprising a second surface; and a cast-in cylinder liner comprising an axis and first and second end surfaces, wherein the first and second end surfaces are respectively in tangential contact with the first and second surfaces in a seated position, such that upon thermal expansion the cylinder liner becomes unseated from the seated position, wherein a first curved region of the double-curved surface is located on a first side of the tangential contact and a second curved region of the double-curved surface is on a second side of the tangential contact, further wherein the double-curved surface forms a portion of one of a spherical surface or a toroidal surface about an axis of the cast-in cylinder liner.

16. The casting mold of claim 15, wherein the first surface is conical.

17. A method of manufacturing a casting mold for an engine block, the method comprising:

providing a first mold seat comprising a first double-curved surface, wherein the double-curved surface forms a portion of one of a spherical surface or a toroidal surface about an axis of the cast-in cylinder liner;

providing a second mold seat comprising a second surface; and placing the cast-in cylinder liner in a seated position in contact with the first and second surfaces respectively at first and second end surfaces of the cylinder liner absent thermal expansion, wherein the first surface is shaped such that upon thermal expansion the cylinder liner becomes unseated.

18. The method of claim 17, wherein the first surface comprises a double-curved portion in contact with the first end surface of the cylinder.

19. The method of claim 17, wherein the first surface comprises a conical portion in contact with the first end surface of the cylinder liner.

20. The method of claim 17, wherein the second surface is shaped such that upon thermal expansion the cylinder liner is unseated from the seated position.

21. The method of claim 20, wherein the second surface comprises a conical portion in contact with the second end surface of the cylinder liner.

* * * * *